US005987886A

United States Patent [19]

Sekiya et al.

[11] Patent Number: 5,987,886

[45] Date of Patent: Nov. 23, 1999

[54] STIRLING CYCLE ENGINE

[75] Inventors: Hiroshi Sekiya, Ota; Takashi Inoue, Oizumi-machi, both of Japan

[73] Assignee: Sanyo Electric Co., Ltd., Moriguchi, Japan

[21] Appl. No.: 08/967,457

[22] Filed: Nov. 13, 1997

[30] Foreign Application Priority Data

Nov. 15, 1996 [JP] Japan ..... 8-318554

[51] Int. Cl.[6] ..... F01B 29/10

[52] U.S. Cl. ..... 60/523; 60/524; 60/526

[58] Field of Search ..... 60/517, 518, 523, 60/524, 525, 526

[56] References Cited

U.S. PATENT DOCUMENTS 3,845,624 11/1974 Roos .
3,971,230 7/1976 Fletcher et al. ..... 62/6
4,511,805 4/1985 Boy-Marcotte et al. ..... 60/525 X
4,532,767 8/1985 Watanabe et al. ..... 60/525
4,583,364 4/1986 Wood .
4,717,405 1/1988 Budliger .
4,738,106 4/1988 Yamaguchi ..... 60/517 X
4,751,819 6/1988 Eder ..... 60/517
5,134,848 8/1992 Taniguchi et al. ..... 60/525 X
5,461,859 10/1995 Beale et al. .
5,755,100 5/1998 Lamos ..... 60/524 X

*Primary Examiner*—Hoang Nguyen
*Attorney, Agent, or Firm*—Oblon, Spivak, McClelland, Maier & Neustadt, P.C.

[57] ABSTRACT

A Stirling cycle engine includes: a housing having at least one cylinder; a motor element disposed in the housing; and a Stirling refrigerator portion driven by the motor element. The cylinder is made to be a cross guide for a piston or a displacer of the Stirling refrigerator portion. Thus, it is possible to provide a desired Stirling cycle engine, for example, a Stirling refrigerator, a Stirling engine generator, etc. with a single configuration.

6 Claims, 13 Drawing Sheets

STIRLING CYCLE ENGINE

BACKGROUND OF THE INVENTION

1. Field of the Invention

The present invention relates to a Stirling cycle engine, and particularly to a desired Stirling cycle engine, for example, a Stirling refrigerator, a Stirling engine generator, etc. which can be provided with a simple configuration and at a low price.

2. Description of the Related Art

The desired Stirling cycle engine, for example, a Stirling refrigerator, a Stirling engine generator, etc. is disclosed in "T. OTAKA, et al., EXPERIMENTAL STUDY ON A 100W CLASS STIRLING CYCLE COOLER, Proc. 7th ICSC, 95 088, 1995" (hereinafter referred to as "Document A"), and "A. BAUMULLER, et al., SOLAR Stirling R+D. ACTIVITIES IN GERMANY, Proc. 7th ICSC, 95 IP02, 1995" (hereinafter referred to as "Document B").

The Stirling refrigerator of a prototype as shown in FIG. 14 is disclosed in document A.

In FIG. 14, the reference numeral 201 represents a vacuum insulating case; 202, a cooling wall; 203, an expansion chamber; 204, a cylinder; 205, a fin; 206, a displacer; 207, a regenerator; 208, a radiator; 209, a pipe; 210, a compression chamber; 211, a piston; 212, a piston rod; 213, a driving disc; 214, a crank shaft; 215, a driving motor; 216, a crank box; 217, a rotary encoder; and 218, a balance weight.

Document A describes that helium is used as a working medium, and the capacity of 100W can be outputted as refrigerating capacity.

On the other hand, Document B describes a Stirling engine applied to a solar system as shown in FIG. 15.

In FIG. 15, a cylinder block 223, a water pipe 224, a gas cooler 225 and a regenerator 226 are provided in a compression piston 222 side with respect to a crank shaft 221 as a reference point. The reference numeral 227 represents a sealing unit.

In addition, a sealing unit 229 is provided in an expansion piston 228 side. The reference numeral 230 represents an oil reservoir; 231, an oil filter; and 232, a solar lighting portion.

The Stirling cycle engine having such a conventional configuration has problems as follows.

The Stirling cycle engines disclosed in Documents A and B have many problems in practical use, and particularly there is a problem that it is difficult to supply parts of a driving portion or purchase parts constituting the driving portion, so that the cost is increased after all.

SUMMARY OF THE INVENTION

It is therefore an object of the present invention to solve the foregoing conventional problems.

It is another object of the invention to provide a Stirling cycle engine which can exhibit desired performance with a simple configuration and at a low price.

In order to achieve the above objects, according to a first aspect of the present invention, there is provided a Stirling cycle engine comprising: a housing having at least one cylinder; a motor element disposed in the housing; and a Stirling refrigerator portion driven by the motor element; the cylinder being made to be a cross guide for a piston or a displacer of the Stirling refrigerator portion.

According to a second aspect of the present invention, there is provided a Stirling cycle engine comprising: a housing having at least one cylinder; a motor element disposed in the housing; and a Stirling refrigerator portion; the cylinder being made to be a cross guide for a piston or a displacer of the Stirling refrigerator portion; the motor element being an electric generator.

According to a third aspect of the present invention, in the Stirling cycle engine according to the above first or second aspect, the cross guides of the pistons or displacers reciprocating in the cylinders provided side by side have a phase difference therebetween.

According to a fourth aspect of the present invention, in the Stirling cycle engine according to the above first or second aspect, an air-tight seal for preventing enclosed gas from leaking is provided on a sealing surface of the housing.

According to a fifth aspect of the present invention, in the Stirling cycle engine according to the above first or second aspect, a flywheel is provided on at least one end of a crank shaft to which a piston or a displacer is connected.

In the Stirling cycle engine according to the present invention, an existing semi-closed compressor is used as the driving portion of the Stirling cycle engine, and a Stirling cycle mechanism portion is connected to a compression element side of the compressor.

Thus, it is possible to provide a desired Stirling cycle engine, for example, a Stirling refrigerator, a Stirling engine generator, etc. with a simple configuration.

DETAILED DESCRIPTION OF THE PREFERRED EMBODIMENTS

Now, various embodiments of the present invention will be described with reference to the accompanying drawings.

First Embodiment

A first embodiment of the present invention will be described below with reference to FIGS. 1 to 7.

First, the configuration of a Stirling cycle engine functioning as a Stirling refrigerator, which is an embodiment of the present invention, will be described with reference to FIGS. 1 and 2.

In a Stirling refrigerator 100 in this embodiment, a known compressor, for example, a semi-hermetic compressor is used as its driving portion. First, the compressor side will be described.

Figure 1:
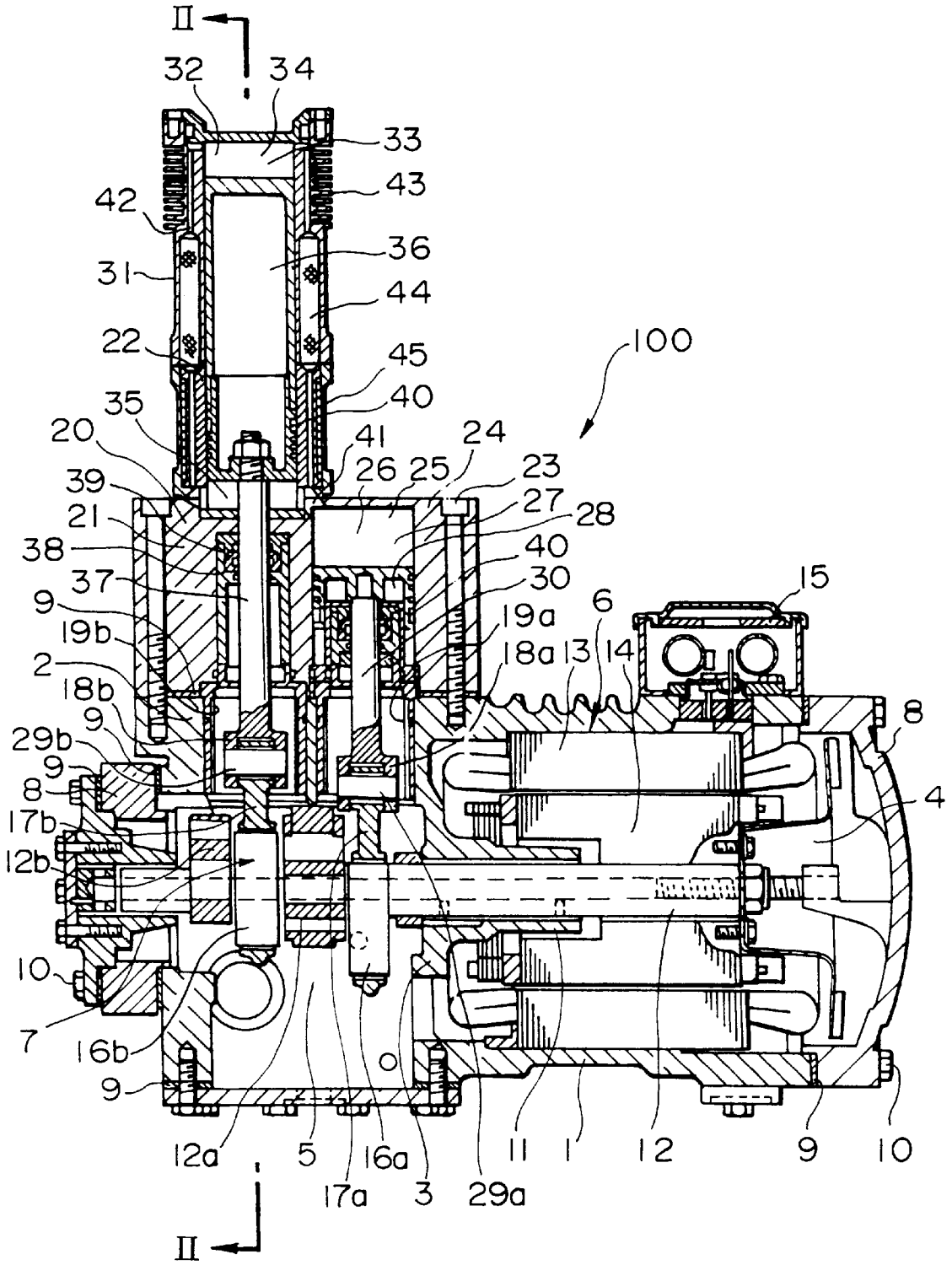
FIG. 1 is a vertical sectional front view illustrating the configuration of a Stirling cycle engine in the case where a first embodiment of the present invention is applied to a Stirling refrigerator.
Figure 2:
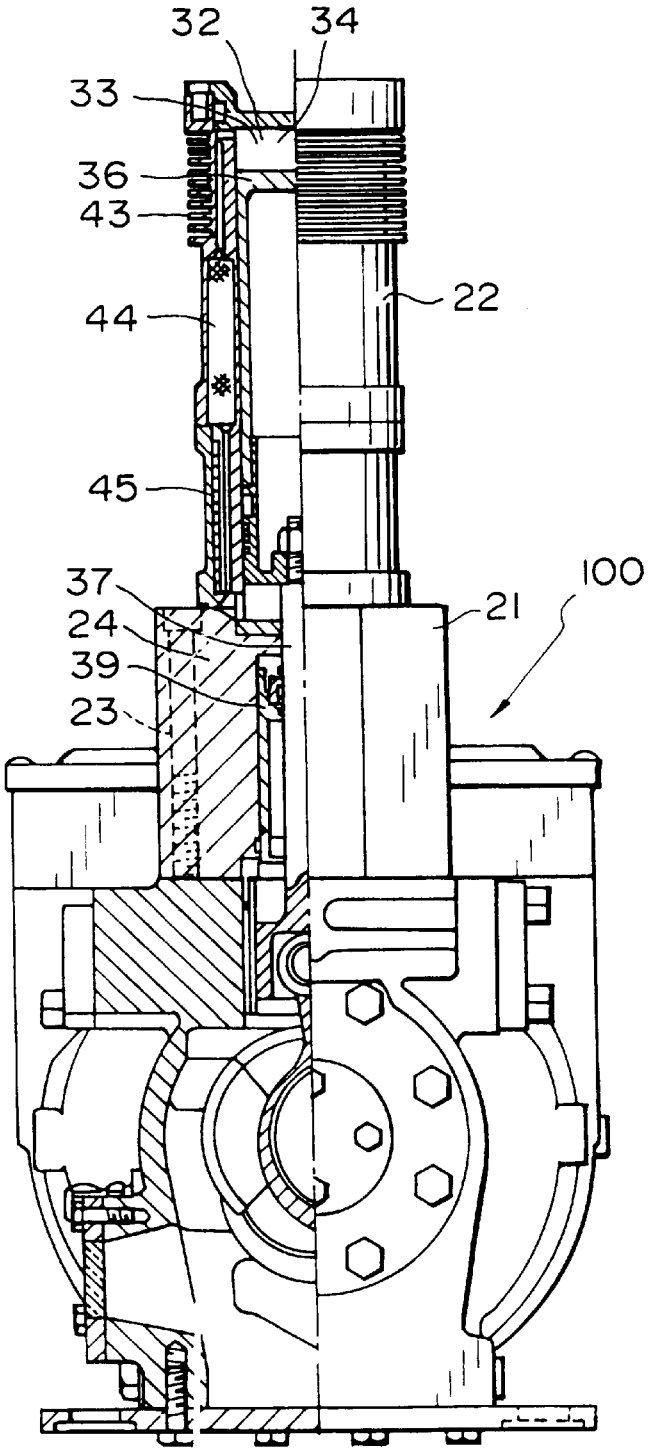
FIG. 2 is a view illustrating the first embodiment of the present invention, which is obtained by viewing FIG. 1 in the direction II—II and half the portion is cut away.

As shown in FIGS. 1 and 2, a housing 1 is formed of a casting and has a cylinder 2. This housing 1 is sectioned into a motor chamber 4 and a crank chamber 5 by a partition wall 3. A motor element 6 is disposed in the motor chamber 4, and a mechanism portion 7 for converting rotational motion into reciprocating motion is disposed in the crank chamber 5. In the case of using the compressor as a semi-hermetic compressor, this mechanism portion 7 functions as a compression element.

The opening in the motor chamber 4 and the opening in the crank chamber 5 are closed by closing members 8 respectively. These closing members 8 are fixed to the housing 1 respectively through very air-tight gaskets 9 by a plurality of bolts 10. In addition, the air-tight gaskets 9 are interposed between the joint portions of the respective parts so as to serve for sealing.

A crank shaft 12 supported by a bearing portion 11 of the partition wall 3 is provided rotatably in the housing 1. The motor element 6 is constituted by a stator 13 fixed to the inner circumferential wall of the motor chamber 4 of the housing 1, and by a rotor 14 provided rotatably on the inner circumferential side of this stator 13. The crank shaft 12 is fixed to the center of the rotor 14. A terminal box 15 connects the motor element 6 to an external power supply (not shown).

The mechanism portion 7 is constituted by crank portions 16*a* and 16*b* of the crank shaft 12 extended into the crank chamber 5, connection rods 17*a* and 17*b* connected to these crank portions 16*a* and 16*b*, and cross guide heads 18*a* and 18*b* attached to the heads of these connection rods 17*a* and 17*b*. The mechanism portion 7 functions as a driving means for the Stirling refrigerator which will be described later. In addition, balance weights 12*a* and 12*b* for balancing with the Stirling refrigerator portion are attached to the crank shaft 12. The cross guide heads 18*a* and 18*b* are provided reciprocatingly in cross guide liners 19*a* and 19*b* provided in the inner wall of the cylinder 2 of the housing 1. The cylinder 2 functions as a chamber for guiding the cross guide heads 18*a* and 18*b*. The crank portions 16*a* and 16*b* are formed with the phase difference of 90°.

A Stirling refrigerator portion 20 is constituted by a compression cylinder 21 disposed above the crank chamber 5 of the housing 1 and an expansion cylinder 22 disposed on this compression cylinder 21.

The compression cylinder 21 is constituted by a compression cylinder block 24 fixed to the housing 1 by bolts 23, a compression piston 28 reciprocating in a space 25 of this compression cylinder block 24 to make this space 25 be a compression space 26 and compress it into a high temperature chamber 27, and a compression piston rod 30 having one end fixed to this compression piston 28 and the other end rotatably connected to the cross guide head 18*a* by a pin 29*a*. Since the sliding direction of the compression piston 28 reciprocating in the space 25 is reversed at the top dead center and the bottom dead center, the speed becomes zero thereat. Then, near the top dead center and the bottom dead center, the speed of the piston 28 is slow and the quantity of the change in volume per unit time is also small. At the intermediate point when the compression piston 28 moves from the bottom dead center to the top dead center, and moves from the top dead center to the bottom dead center, the speed of the piston is highest and the quantity of the change in volume per unit time due to the movement of the piston is also maximum.

The expansion cylinder 22 is constituted by an expansion cylinder block 31 fixed to the upper portion of the compression cylinder 21 by a bolt (not shown), a displacer piston 36 which slides and reciprocates in a space 32 of this expansion cylinder block 31 so that the upper portion of this space 32 is made to be an expansion space 33 which is expanded into a low temperature chamber 34 while the lower portion of the spacer 32 is made to be a working space 35, and a displacer piston rod 37 having one end fixed to this displacer piston 36 and the other end rotatably connected to the cross guide head 18*b* by a pin 29*b* through the compression cylinder block 24. The displacer piston rod 37 is sealed by a shaft sealing unit 39 disposed in a through hole 38 of the compression cylinder block 24.

The compression piston 28 is 90° behind in phase than the displacer piston 36. In addition, sealing rings 40 are provided on the sliding surfaces of the compression piston 28 and the displacer piston 36 respectively.

Passages 41 for making the compression space 26 communicate with the working space 35 are formed in the compression cylinder block 24 and the expansion cylinder block 31 respectively.

A path 42 for making the expansion space 33 communicate with the working space 35 is formed in the expansion cylinder block 31. In this path 42, a cooler 43 for cooling the outside, a cool accumulator 44, and a radiator 45 are provided in this order.

As working gas for the Stirling refrigerator 100 an enclosed gas in the housing 1, for example, helium, hydrogen, nitrogen, etc., may be used, and helium is used in the embodiment. Incidentally, since it is impossible to prevent completely the working gas from leaking from the compression piston, the same gas as the working gas is used as the enclosed gas in the housing taking the leakage of the working gas into consideration.

Figure 3:
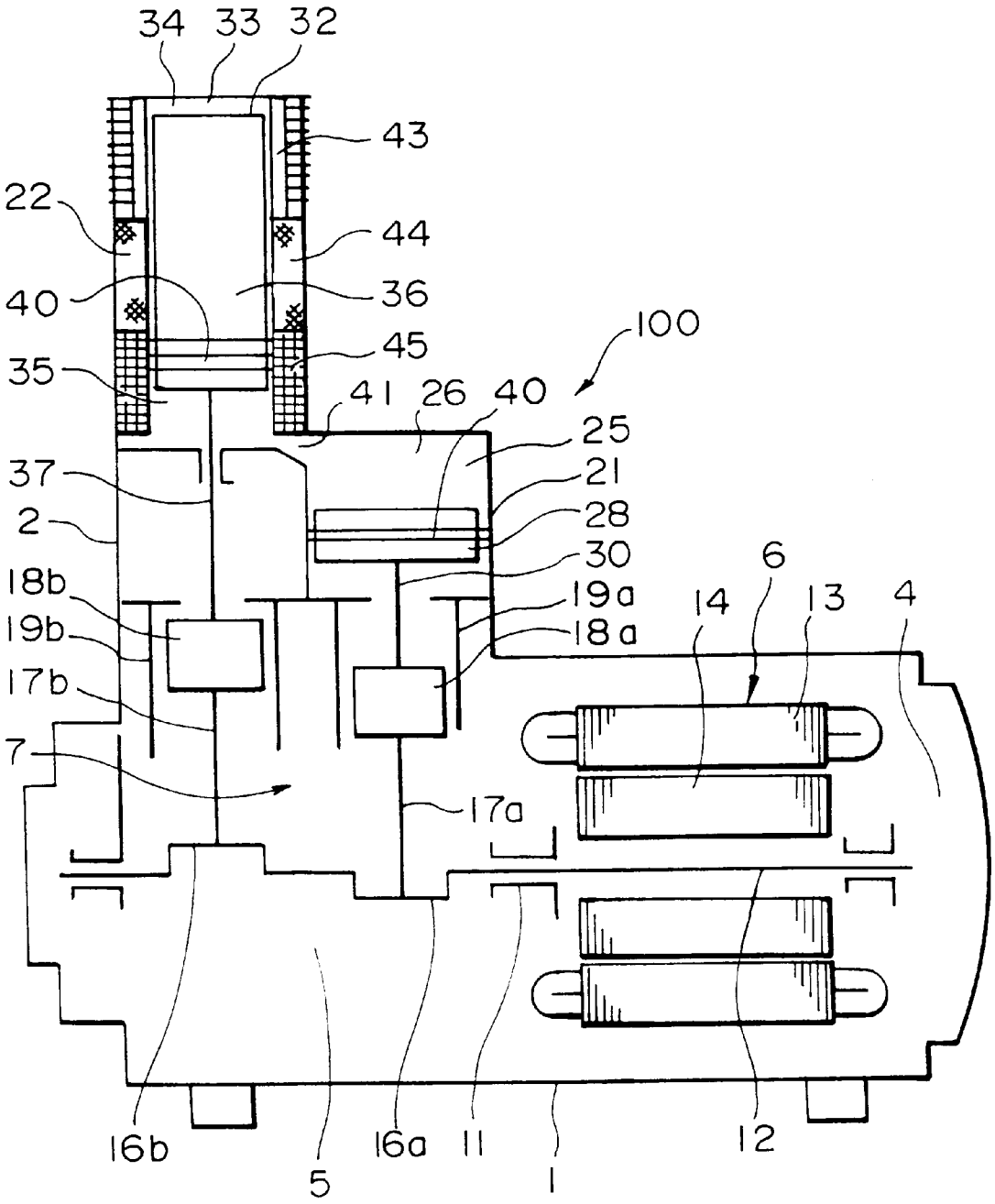
FIG. 3 is a view illustrating the first embodiment of the present invention, which is obtained by simplifying the configuration of the Stirling cycle engine of FIG. 1.

Next, the configuration of the Stirling refrigerator in FIG. 1 will be described with reference to FIG. 3 illustrating the same in a simplified manner for the purpose of describing the following respective embodiments.

This Stirling refrigerator 100 is constituted by the "annular arrangement of a heat exchanger with one displacer and one piston".

First, the crank shaft 12 is rotated by the motor element 6, and the crank portions 16*a* and 16*b* in the crank chamber 5 are rotated so that their phases are shifted from each other by 90°. The connection rods 17*a* and 17*b* rotatably connected to the crank portions 16*a* and 16*b* slide so that the cross guide heads 18*a* and 18*b* attached to the heads of the connection rods 17*a* and 17*b* slide reciprocatingly in the cross guide liners 19*a* and 19*b* provided in the cylinder 2. The working gas of the compression space 26 in the compression cylinder block is compressed by the compression piston 28 connected to the cross guide head 18*a* through the compression piston rod 30 when the compression piston 28 moves toward the top dead center. Then, the working gas is introduced into the working space 35 through the passage 41. The working gas introduced into the working space 35 is discharged to the radiator 45 when the displacer piston 36 connected to the cross guide head 18*b* through the displacer piston rod 37 moves downward. The working gas the heat of which is radiated to the outside by the radiator 45 is cooled in the cool accumulator 44, and flows into the expansion space 33 through the cooler 43. Between the working space 35 and the expansion space 33, the working gas is merely moved in the moving direction of the displacer piston 36, and there arises no change in pressure when the working gas is moved between the working space 35 and the expansion space 33. That is, compression or expansion is not produced only by the displacer piston 36.

When the displacer piston 36 comes to the position of 90° toward the bottom dead center and the speed reaches the maximum value, the compression piston 28 reaches the top dead center and the speed becomes zero. When the compression piston 28 moves toward the bottom dead center, its speed is low and the change in increase of the volume of the compression space 26 is small, while the speed of the displacer piston 36 becomes maximum and the change in volume of the working space 35 and the expansion space 33 is large so that the working gas in the working space 35 moves into the expansion space 33. Further, when the displacer piston 36 comes near the bottom dead center, the volume in the expansion space 33 becomes maximum. At that time, the compression piston 28 comes near the intermediate position at the rotation angle 90° toward the bottom dead center, and also the speed becomes maximum. Therefore, when the working gas in the compression space 26 begins to expand so that the pressure of this working gas becomes low, the working gas in the expansion space 33 moves into the compression space 26 instantaneously and begins to expand so as to generate cool temperature.

The working gas cooled in the expansion space 33 is discharged from the expansion space 33 into the cooler 43 when the displacer piston 36 comes to the top dead center to thereby reduce the expansion space 33. The thus discharged working gas exchanges heat with the outside in the cooler 43 so as to cool an object to be cooled and so as to accumulate heat in the cool accumulator 44, and exchanges heat with a medium such as outside air, water or the like in the radiator 45. The working gas then flows into the working space 35, and sucked from the working space 35 into the compression space 26 through the passage 41. Such a cycle is repeated in the same manner, so that the working gas can be cooled to a very low temperature in a range of from −30° to −200° in the Stirling refrigerator 100.

Although description has been made about the case where the compression piston 28 and the displacer piston 36 have a phase difference of 90°, they can function as a Stirling cycle engine even if the phase difference is set to be in a range of from about 60° to about 120°.

In addition, when the Stirling cycle engine is configured as a Stirling engine generator, it will do to make the configuration so that the compression piston 28, the low temperature chamber 34, the cooler 43 and the cool accumulator 44 are replaced by a power piston, a high temperature chamber, a heater and a regenerator, respectively.

Figure 4:
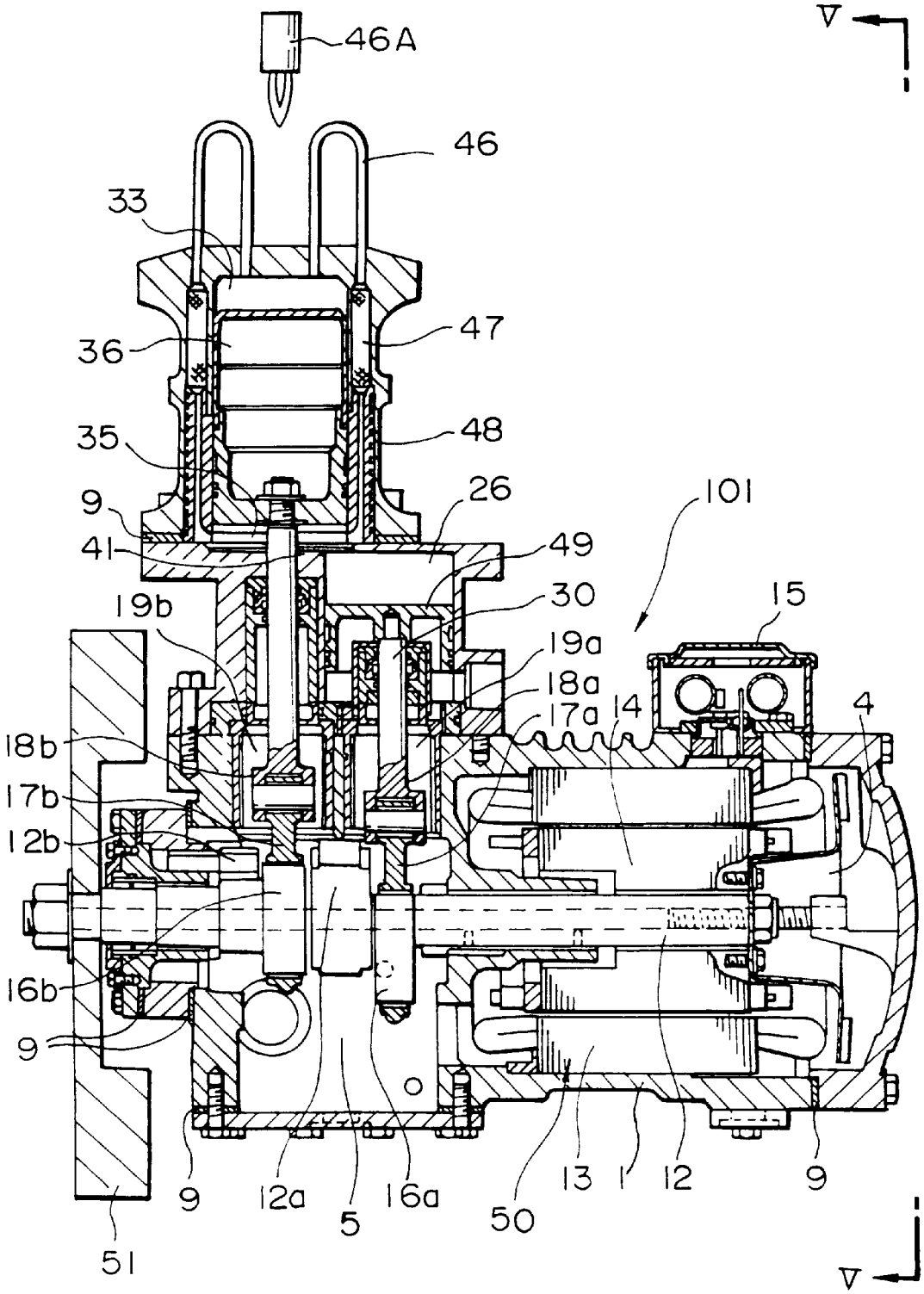
FIG. 4 is a vertical sectional front view illustrating the configuration of a Stirling cycle engine in the case where the first embodiment of the present invention is carried out as a Stirling engine generator.
Figure 5:
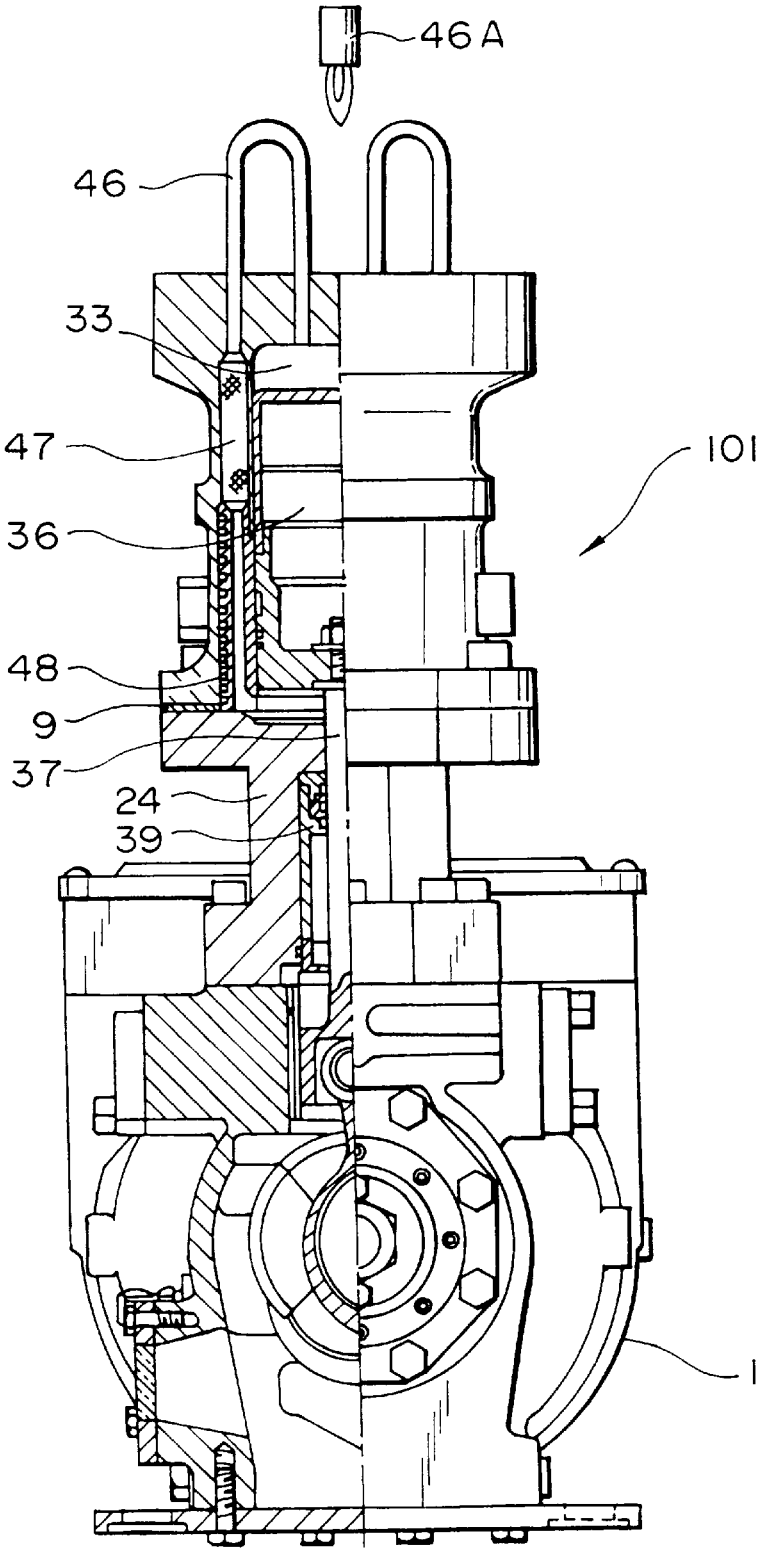
FIG. 5 is a view illustrating the first embodiment of the present invention, which is obtained by viewing FIG. 4 in the direction V—V and half the portion is cut away.

An embodiment of a Stirling cycle engine 101 functioning as a Stirling engine generator having such a configuration is illustrated specifically in FIGS. 4 and 5.

In FIGS. 4 and 5, constituent parts corresponding to those in FIGS. 1, 2 and 3 are referenced correspondingly, and the duplicate description about them is omitted.

In FIGS. 4 and 5, there is an inverted-U-shaped heater 46. This heater 46 is heated by a heat source 46A such as a burner. A regenerator 47 accumulates the heat of working gas heated in the heater 46 by the heat source 46A. A power piston 49 is designed so that the expansion caused by heating the working gas acts thereon as pressure. A generator 50 supplies electric power to the outside. In addition, a flywheel 51 controls the fluctuation of the output of the generator 50.

In the Stirling engine generator configured thus, the working gas in the expansion space 33 absorbs heat to expand when the heater 46 is heated by the burner of the heat source 46A. At this time, the displacer piston 36 is pushed down toward the bottom dead center. When the displacer piston 36 which has reached the bottom dead center and changed in direction moves toward the top dead center, the working gas in the expansion chamber 33 flows into the compression space 26 from the heater 46 through the regenerator 47 and a cooler 48. Then, the heat of the working gas is accumulated in the regenerator 47. The pressure of the working gas itself flowing into the compressing space 26 is high so as to push down the compression power piston 49 toward the bottom dead center. The crank shaft 12 is rotated by this pressure acting on the top surface of the compression power piston 49 so as to drive the generator 50. In addition, the working gas acting on the power piston 49 flows into the expansion space 33 through the cooler 48, the regenerator 47 and the heater 46 with the displacer piston 36 moving toward the bottom dead center. Then, the working gas is heated by the heat accumulated in the regenerator 47, and further heated by the burner of the heat source 46A. By repeating these processes, the power piston 49 is moved reciprocatingly to rotate the crank shaft 12 through the connection rod 17*a* and the crank portion 16*a* to thereby drive the generator 50. The electric power obtained by the generator 50 is supplied to the outside through the terminal box 15.

Figure 6:
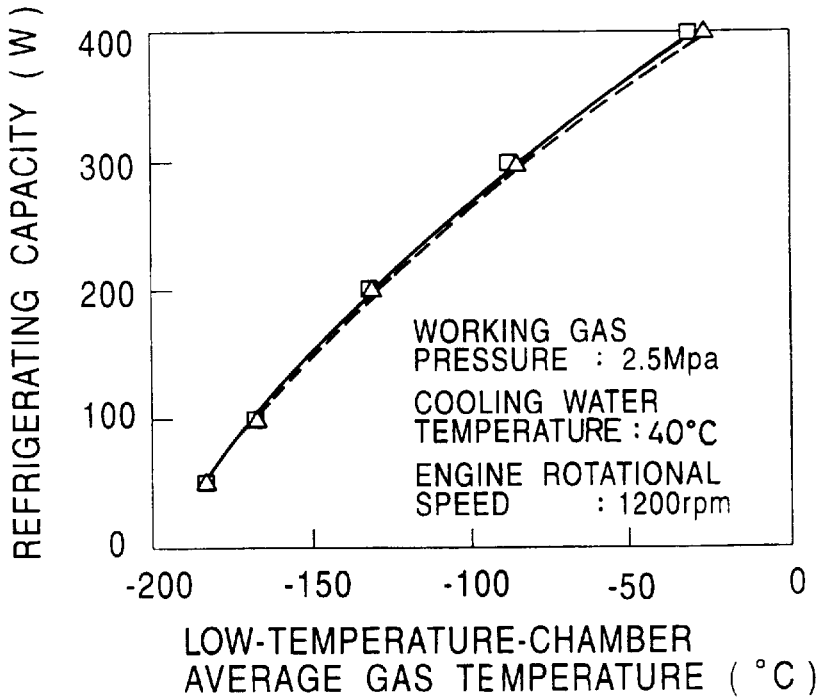
FIG. 6 is a characteristic diagram showing the refrigerating capacity to temperature of the Stirling cycle engine shown in FIGS. 4 and 5 according to the first embodiment of the present invention.
Figure 7:
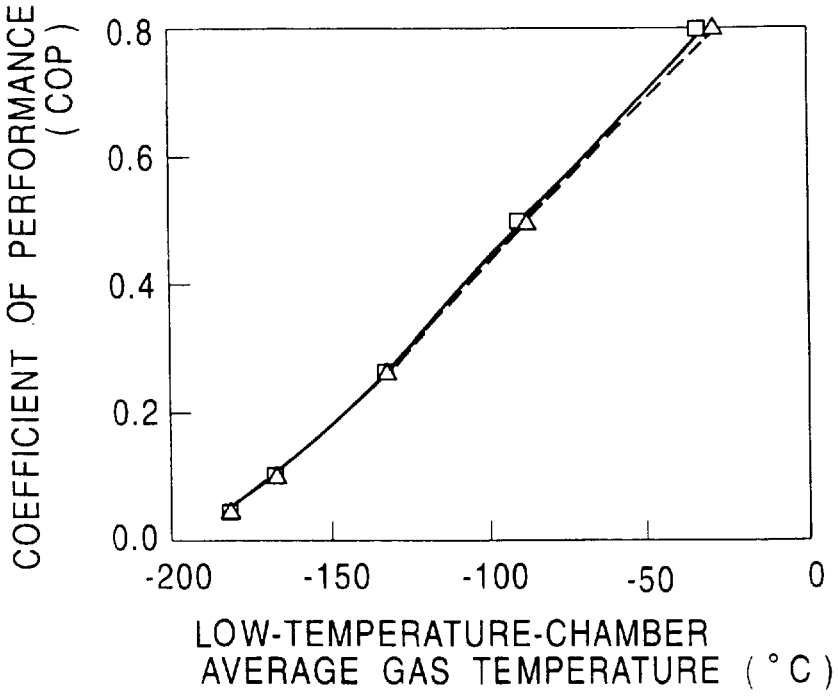
FIG. 7 is a characteristic diagram showing the coefficient-of-performance to temperature of the Stirling cycle engine shown in FIGS. 4 and 5 according to the first embodiment of the present invention.

FIGS. 6 and 7 are characteristic diagrams of the Stirling cycle engine according to this embodiment. Specifically, FIG. 6 is a characteristic diagram showing the relationship between the low temperature chamber average gas temperature (°C.) and the refrigerating capacity (W), and FIG. 7 is a characteristic diagram showing the relationship between the low temperature chamber average gas temperature (°C.) and the coefficient of performance (COP).

As shown in the respective characteristic diagrams of FIGS. 6 and 7, it is confirmed that the Stirling cycle engine according to this embodiment has a high refrigerating capacity and a high coefficient of performance even at a very low average gas temperature in a range of from −100° C. to −200° C.

Second Embodiment

Next, a second embodiment of the present invention functioning as a Stirling refrigerator 102 will be described with reference to FIG. 8.

The Stirling refrigerator 102 according to this second embodiment is constituted by the "annular arrangement of a heat exchanger with two pistons".

In this embodiment, parts corresponding to those in the first embodiment are referenced correspondingly to FIG. 3, and description about them will be omitted.

Figure 8:
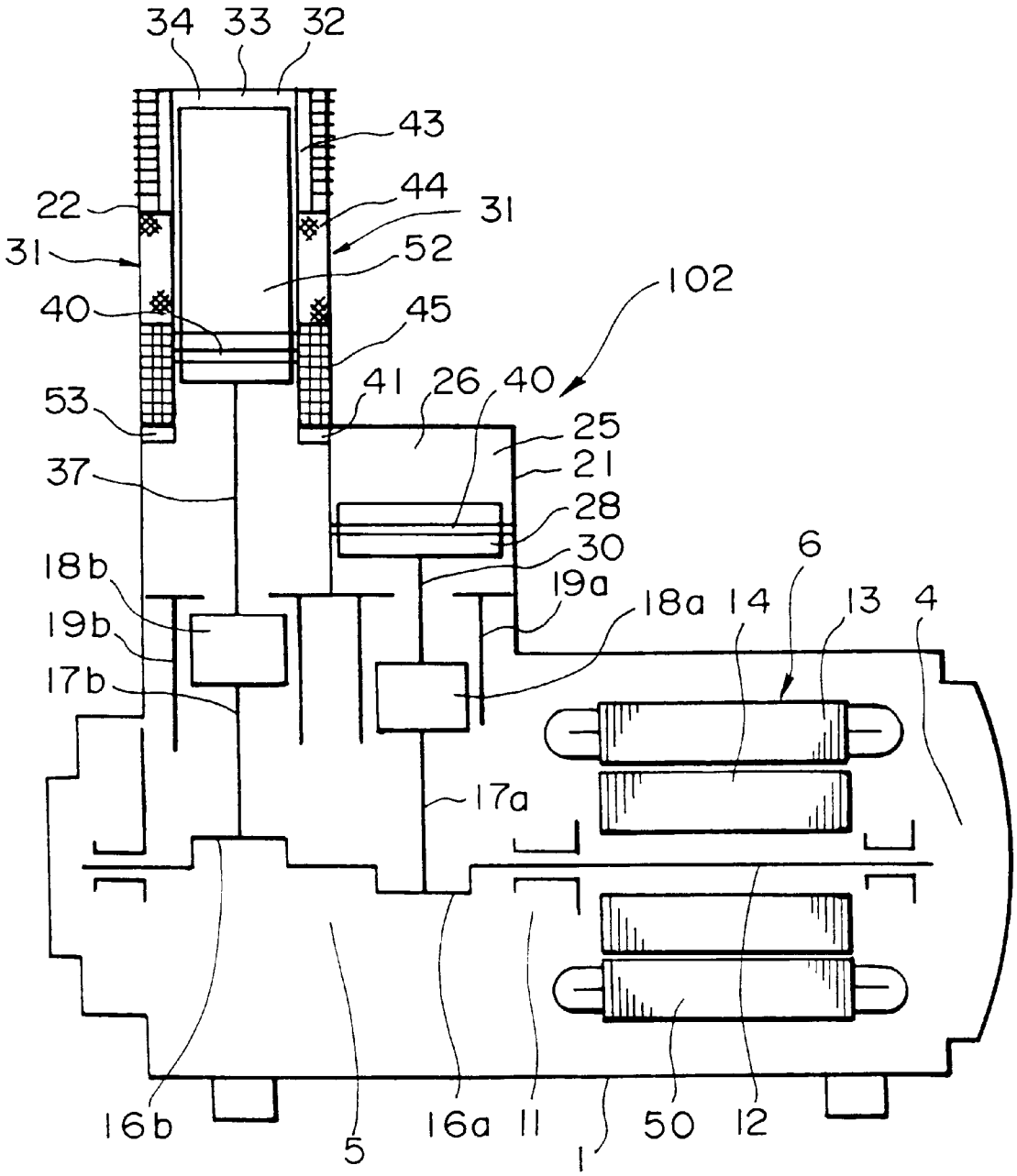
FIG. 8 is a view illustrating a second embodiment of the present invention, in which the configuration of a Stirling cycle engine is simplified.

In FIG. 8, an expansion piston 52 is disposed in the position corresponding to the displacer piston 36 shown in the first embodiment. Since the expansion piston 52 has a function similar to that of the compression piston 28, the change of volume in a space charged with working gas in the Stirling refrigerator 102 is made larger, so that the Stirling refrigerator 102 can be provided with a large refrigerating capacity.

In addition, since devices for heat exchange are disposed annularly, the "annular arrangement of a heat exchanger" is established in the same manner as in the first embodiment, so that the cooler 43, the cool accumulator 44 and the radiator 45 are disposed in the expansion cylinder block 31 of the expansion cylinder 22 in this order. A manifold 53 communicating with the compression space 26 is disposed at the lower end of the radiator 45.

With this configuration, working gas in the compression space 26 is compressed by the compression piston 28, and discharged from the passage 41 into the radiator 45 through the manifold 53. The working gas the heat of which has been radiated to the outside by this radiator 45 is cooled by the cool accumulator 44, and flows into the expansion space 33 through the cooler 43. The working gas compressed in the compression space 26 flows into this expansion space 33 by the downward sliding motion of the expansion piston 52. Since the compression piston 28 moves with a phase which is 90° behind that of the expansion piston 52, the compression piston 28 comes near the intermediate position when the expansion piston 52 comes near the bottom dead center, so that the pressure in the compression space 26 decreases suddenly, and the working gas in the expansion space 33 moves into the compression space 26 instantaneously. Consequently, the working gas in the expansion space 33 expands to generate cooling temperature. In addition, since the compression piston 28 and the expansion piston 52 compress the working gas in the compression space 26 and the expansion space 33, the change of volume of the working gas is large so that the refrigerating capacity of the Stirling refrigerator 102 is improved.

Further, also in the case of the second embodiment, in order to configure the Stirling cycle engine as a Stirling engine generator, it will do to replace the compression piston 28 and the expansion piston 52 by power pistons; and replace the low temperature chamber 34, the cooler 43 and the cool accumulator 44 by a high temperature chamber, a heater and a regenerator respectively. In this case, the pressure caused by the expansion of the heated working gas acts on both the compression piston 28 and the expansion piston 52 to push the respective pistons 28 and 52 downward to thereby rotate the crank shaft 12 so as to drive the generator 50.

Third Embodiment

Figure 9:
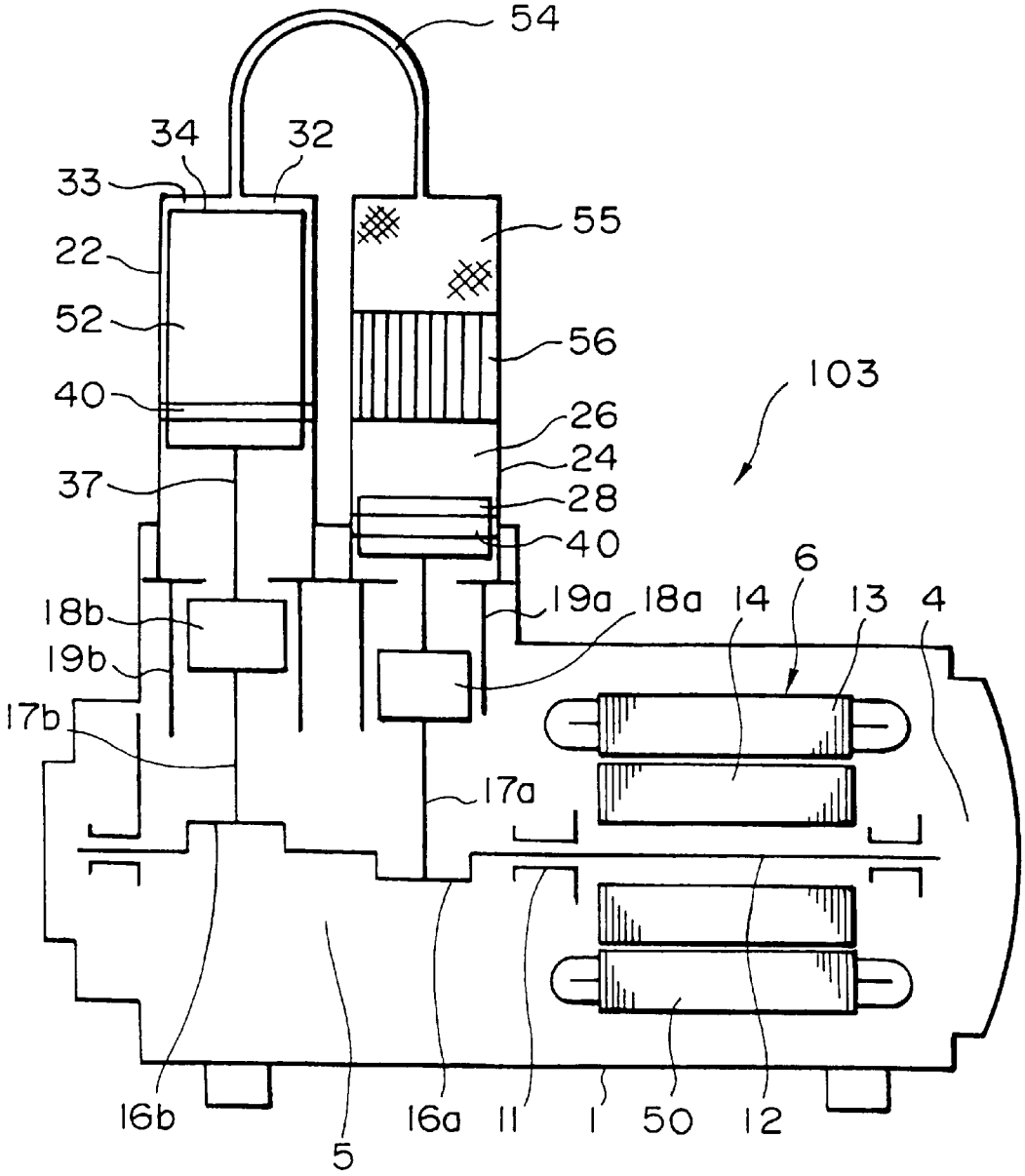
FIG. 9 is a view illustrating a third embodiment of the present invention, in which the configuration of a Stirling cycle engine is simplified.

Next, a third embodiment of the present invention functioning as a Stirling refrigerator 103 will be described with reference to FIG. 9. The Stirling refrigerator 103 according to this third embodiment is constituted by the "canister arrangement of a heat exchanger with two pistons".

In addition, in this embodiment, the configuration of the cooler, the cool accumulator and the radiator in the first embodiment is changed. An inverted-U-shaped cooler 54, a cool accumulator 55 and a radiator 56 are disposed separately above the compression cylinder block 24 so that the cool accumulator 55 and the radiator 56 are connected to each other through the cooler 54 as shown in FIG. 9.

The configuration of other parts in this embodiment is the same as in the first and second embodiments. Accordingly, in the third embodiment, parts the same as those shown in FIGS. 3 and 8 are referenced correspondingly, and duplicate description about them will be omitted.

In this embodiment, since the expansion piston 52 is configured so as to have a function similar to that of the compression piston 28 in the same manner as in the second embodiment, the change of volume of a space charged with working gas in the Stirling refrigerator 103 is made large so that the Stirling refrigerator 103 can be provided with a large refrigerating capacity.

In addition, devices for heat exchange are disposed not annularly but separately. That is, the inverted-U-shaped cooler 54, the cool accumulator 55 and the radiator 56 are disposed in series. This is called "canister arrangement of a heat exchanger" herein.

Also in this third embodiment, in order to configure the Stirling cycle engine as a Stirling engine generator, it will do to replace the compression piston 28 and the expansion piston 52 by power pistons; and replace the low temperature chamber 34, the cooler 54, the cool accumulator 55 and the radiator 56 by a high temperature chamber, a heater, a regenerator and a cooler respectively.

Fourth Embodiment

Figure 10:
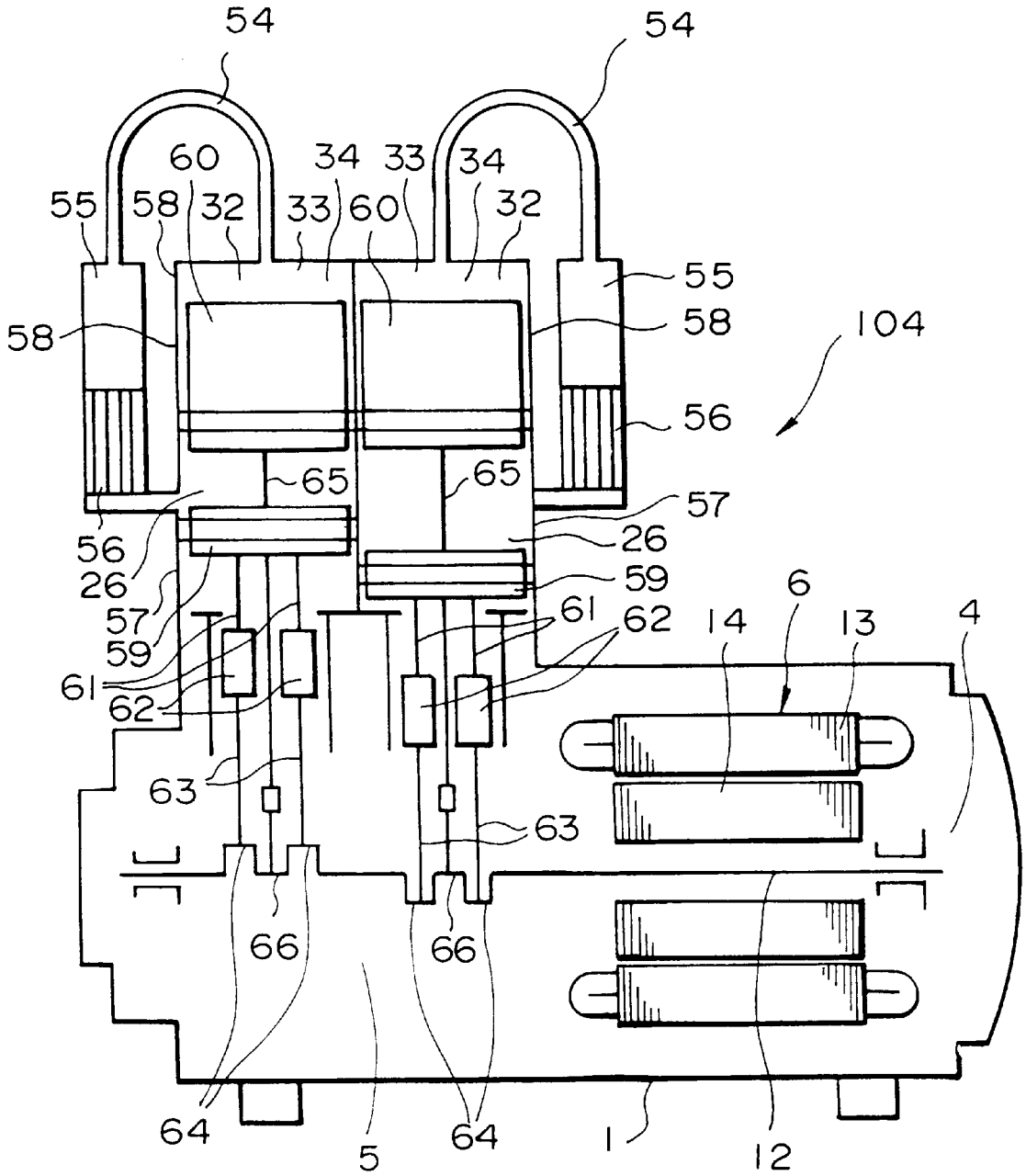
FIG. 10 is a view illustrating a fourth embodiment of the present invention, in which the configuration of a Stirling cycle engine is simplified.

Next, a fourth embodiment of the present invention functioning as a Stirling refrigerator 104 will be described with reference to FIG. 10. The Stirling refrigerator 104 according to this fourth embodiment is constituted by the "canister arrangement of a heat exchanger with one displacer and one piston".

In addition, in this embodiment, two pairs of compression cylinders 57 and expansion cylinders 58 are provided, and a compression piston 59 and a displacer piston 60 are disposed in each pair of cylinders.

In connection to the compressor side, first, the right and left compression pistons 59 are connected to two crank portions 64 of the crank shaft 12 through two compression piston rods 61, two cross guide heads 62 and two connection rods 63 respectively.

In addition, the right and left displacer pistons 60 are connected to two crank portions 66 of the crank shaft 12 while penetrating the centers of the displacer piston rods 65 and the compression pistons 59 respectively. As the canister arrangement of a heat exchanger, the inverted-U-shaped cooler 54, the cool accumulator 55 and the radiator 56 are connected in series.

In this case, the compression pistons 59 and the displacer pistons 60 are set so as to have a phase difference of 90°.

The two sets of Stirling cycle engines are disposed with a phase difference of 180°. This arrangement is established taking the balance of the two sets of Stirling cycle engines into consideration.

In addition, in this case, the two sets of the configurations of "one displacer and one piston" are provided, and a device for heat exchange is arranged not annularly but separately. Therefore, this arrangement is called "canister arrangement of a heat exchanger". However, the heat exchanger may be arranged annularly.

Also in the case of the fourth embodiment, in order to configure the Stirling cycle engine as a Stirling engine generator, it will do to replace the compression piston 59, the low temperature chamber 34, the cooler 54, the cool accumulator 55 and the radiator 56 by a power piston, a high temperature chamber, a heater, a regenerator and a cooler respectively.

Fifth Embodiment

Next, a fifth embodiment of the present invention functioning as a Stirling refrigerator 105 will be described with reference to FIG. 11. The Stirling refrigerator 105 according to this fifth embodiment is constituted by the "annular arrangement of a heat exchanger with one displacer and one piston".

In this embodiment, parts the same as those in the first embodiment illustrated in FIG. 1 are referenced correspondingly, and the description about them will be omitted.

Figure 11:
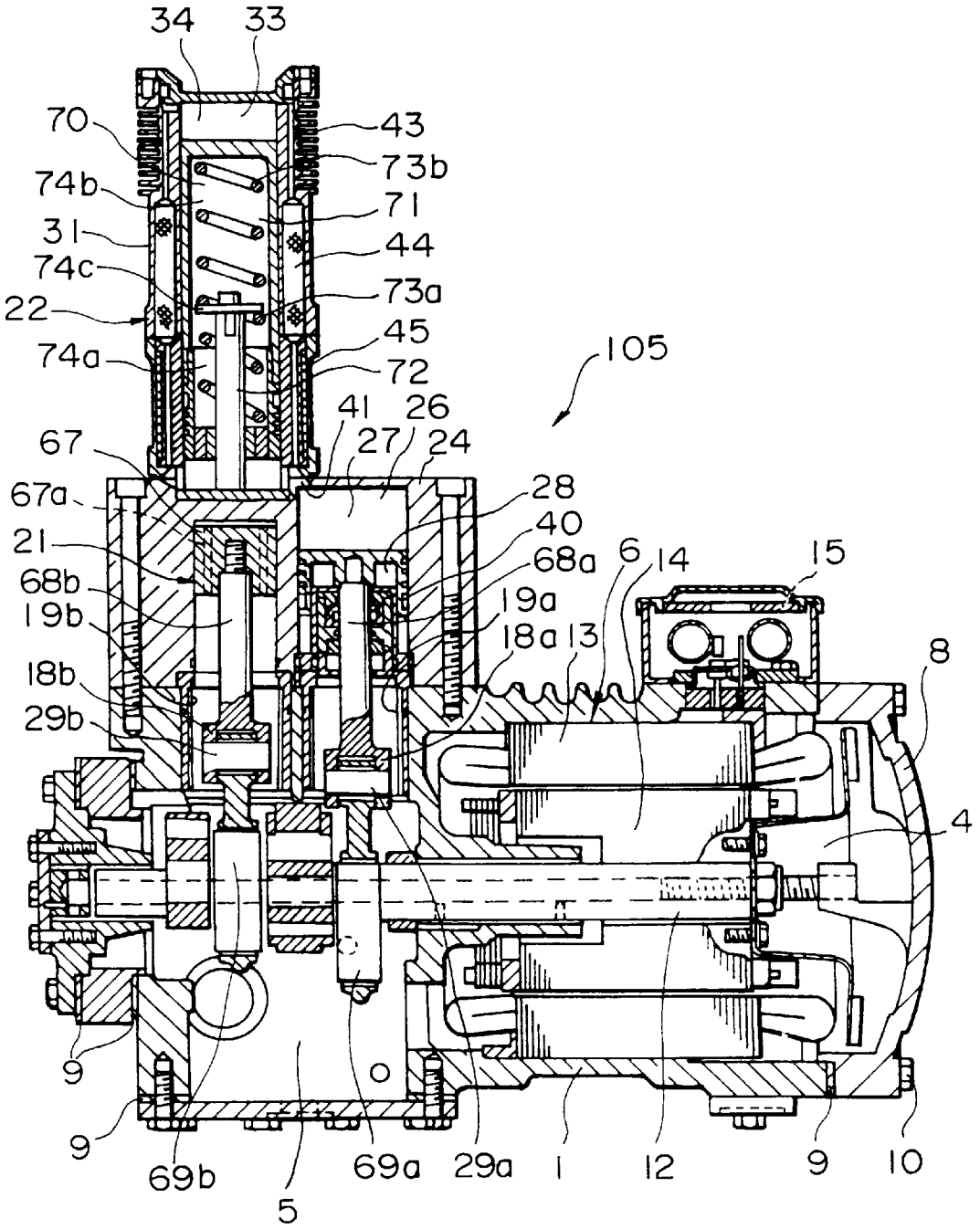
FIG. 11 is a vertical sectional front view illustrating the configuration of a Stirling cycle engine of a fifth embodiment of the present invention.

In FIG. 11, in the compression cylinder block 24 of the compression cylinder 21, the compression piston 28 and a balance piston 67 for making a balance between the compression piston 28 and the balance piston 67 are slidably connected to the cross guide heads 18*a* and 18*b* through piston rods 68*a* and 68*b* respectively. The compression piston 28 and the balance piston 67 slide while they are made different in phase by 180° by means of crank portions 69*a* and 69*b* of the crank shaft 12 respectively. Passages 67*a* are formed through the balance piston 67 so as to make the upper and lower portions of the balance piston 67 communicate with each other so that the balance piston 67 does not perform compressing action.

A free type displacer piston 71 having a hollow chamber 70 is disposed in the expansion cylinder block 31 of the expansion cylinder 22. The displacer piston 71 has a displacer guide rod 72 which is fixed on the upper end of the compression cylinder block 24 and which faces the hollow chamber 70. The displacer piston 71 is attached so as to be slidable by means of two compression springs 73*a* and 73*b* attached to be in opposition to each other on the top end of the displacer guide rod 72. On the portion of the displacer guide rod 72 where the compression springs 73*a* and 73*b* are attached, there is provided a partition member 74*c* for partitioning the hollow space 70 of the displacer piston 71 into a pair of gas spring chambers 74*a* and 74*b* in which the compression springs 73*a* and 73*b* are disposed respectively.

Figure 12:
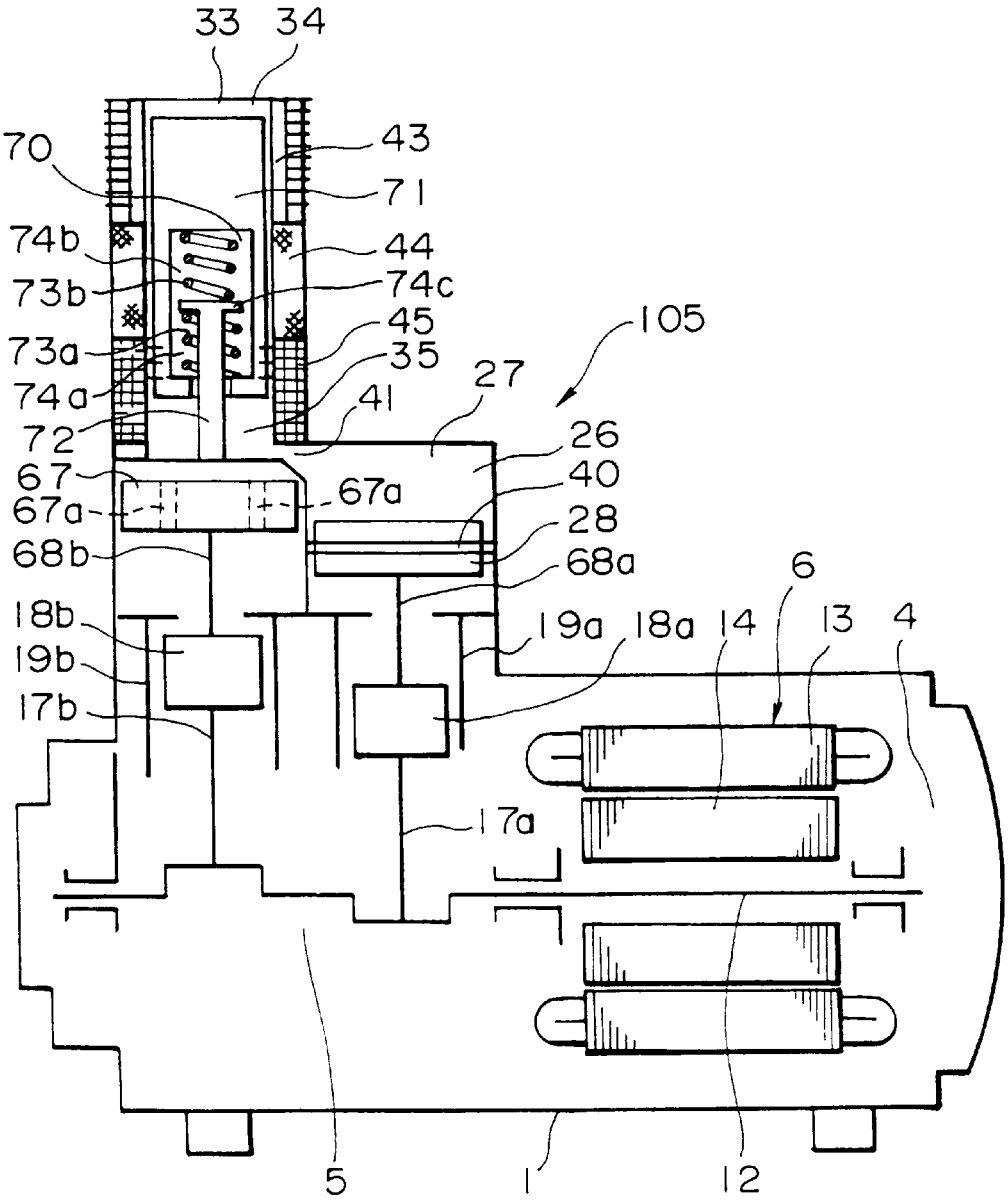
FIG. 12 is a view illustrating the fifth embodiment of the present invention, in which the configuration of a Stirling cycle engine of FIG. 11 is simplified.

The configuration of the Stirling refrigerator 105 of FIG. 11 will be further described with reference to FIG. 12 which is a simplified illustration of the same.

As for the displacer piston 71, when the working gas in the compression space 26 is compressed by the compression piston 28, the compressed working gas is supplied to the working space 35 and the expansion space 33. Therefore, the pressure in the working space 35 becomes high, even up to the pressure in the expansion space 33. However, the area receiving pressure of the top surface of the displacer piston 71 on the working space 35 side is smaller than that of the top surface of the displacer piston 71 on the expansion space 33 side by the size of the displacer guide rod 72. Therefore, the displacer piston 71 moves toward the bottom dead position so that the volume in the expansion space 33 becomes large while the volume in the working space 35 becomes small. On this occasion, the pressure difference between the expansion space 33 and the working gas 35 is larger than the total spring constant of the compression spring 73*a* and the gas spring 74*a* in the hollow chamber 70, so that the displacer piston 71 moves toward the bottom dead point. When the working gas is sucked into the compression chamber 26 by the compression piston 28, the pressure of the working gas in the expansion space 33 is reduced. Therefore, the pressure in the expansion space 33 is smaller than the total spring constant of the compression spring 73*a* and the gas spring chamber 74*a* in the hollow chamber 70, so that the displacer piston 71 moves toward the top dead position. The displacer piston 71 is made to slide reciprocatingly by the compression and suction strokes of the compression piston 28 and by the compression springs 73*a* and 73*b* and the gas spring chambers 74*a* and 74*b* in the hollow chamber 70.

The displacer piston 71 is made to slide reciprocatingly with a phase advanced by 90° more than the compression piston 28 by properly adjusting the weight of the displacer piston 71 itself, the spring constant of the compression springs 73*a* and 73*b* and the spring constant of the gas spring chambers 74*a* and 74*b*, and the thickness of the displacer guide rod 72 (the difference of area between the top surfaces of the displacer piston 71).

The balancing weight of the crank shaft 12 can be eliminated by making the balance piston 67 to slide reciprocatingly with a 180° phase difference from the compression piston 28.

In order to configure the Stirling cycle engine as a Stirling engine generator in this fifth embodiment, it will do to replace the compression piston 28, the low temperature chamber 34, the cooler 43, the cool accumulator 44 and the radiator 45 by a power piston, a high temperature chamber, a heater, a regenerator and a cooler, respectively.

Sixth Embodiment

Figure 13:
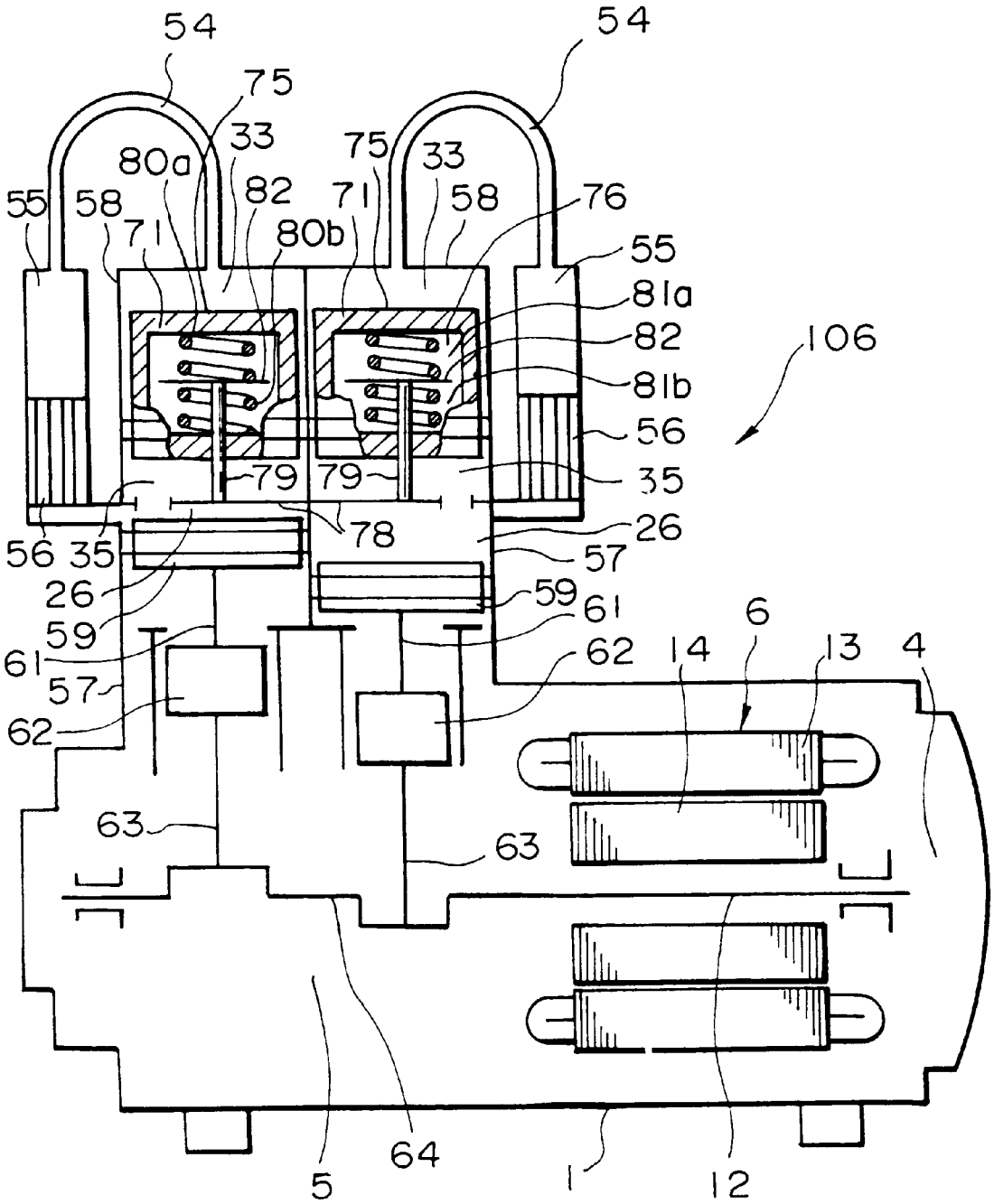
FIG. 13 is a view illustrating a sixth embodiment of the present invention, in which the configuration of a Stirling cycle engine is simplified.
Figure 14:
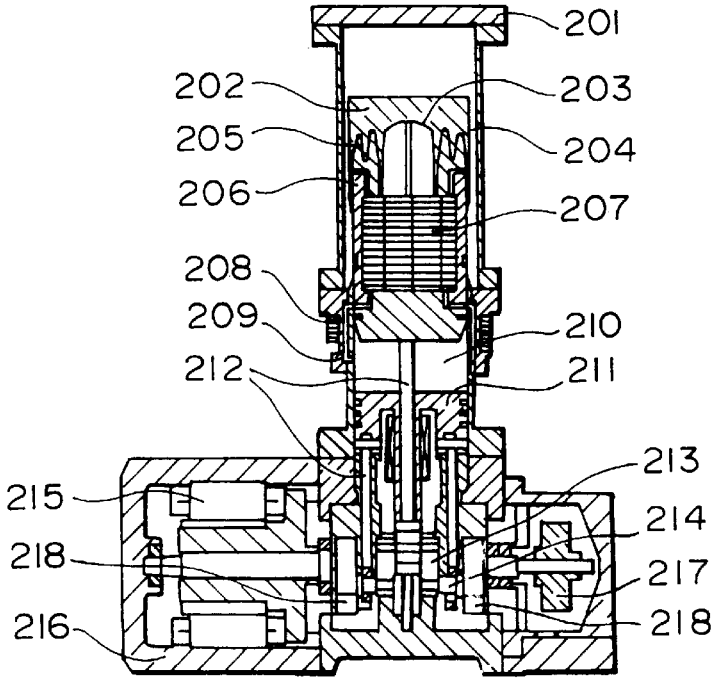
FIG. 14 PRIOR ART
FIG. 14 is a vertical sectional front view illustrating the configuration of a Stirling refrigerator of the prototype disclosed in document A as a conventional example.
Figure 15:
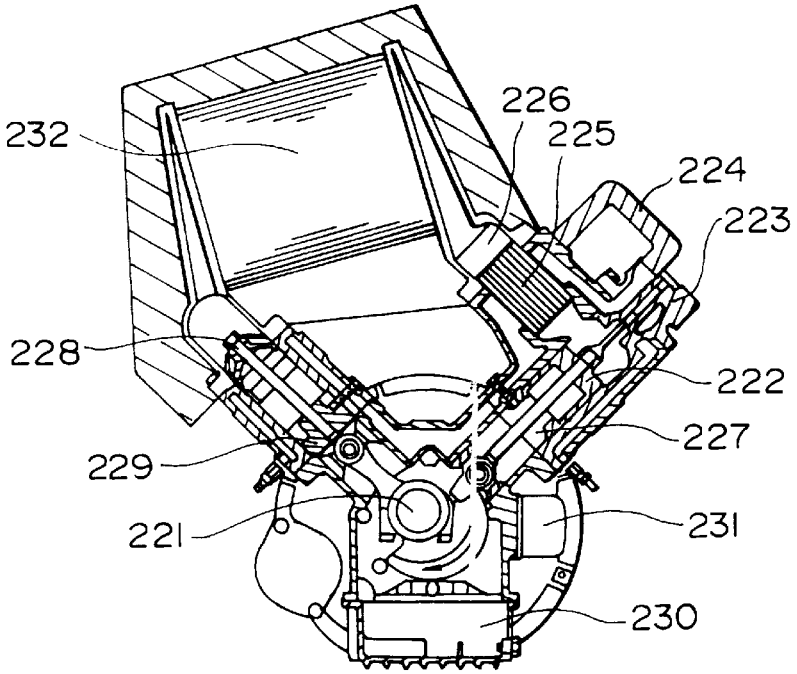
FIG. 15 PRIOR ART
FIG. 15 is a vertical sectional front view illustrating the configuration of a Stirling engine applied to a solar system disclosed in document B as another conventional example.

Next, the sixth embodiment functioning as a Stirling refrigerator 106 according to the present invention will be described with reference to FIG. 13. The Stirling refrigerator 106 is constituted by "canister arrangement of a heat exchanger with one displacer and one piston".

In this embodiment, two pairs of compression cylinders 57 and expansion cylinders 58 are provided, and compression pistons 59 and free type displacer pistons 71 are provided in the two pairs of cylinders respectively.

In connection to a compressor side, first, the right and left compression pistons 59 are connected to the crank portion 64 of the crank shaft 12 through compression piston rods 61, the cross guide heads 62, and the connection rods 63.

A free type displacer piston 77 the inside of which is made to be a hollow chamber 76 is provided in an expansion cylinder block 75 of each of the left and right expansion cylinders 58. The displacer piston 71 has a displacer guide rod 79 which is fixed to a partition member 78 provided between the compression space 26 and the working space 35 and which faces the hollow chamber 76. The displacer piston 71 is slidably attached by two compression springs 80*a* and 80*b* attached so as to be in opposition to each other on the top end of the displacer guide rod 79. On the portion of the displacer guide rod 79 where the compression springs 80*a* and 80*b* are attached, there is provided a partition member 82 for partitioning the hollow chamber 76 into a pair of gas spring chambers 81*a* and 81*b* in which the compression springs 80*a* and 80*b* are disposed.

Also in this case, the compression piston 59 and the displacer piston 71 are set so as to be different in phase by 90°.

Two sets of the Stirling cycle engines are arranged so as to be different in phase by 180°. This arrangement is set taking the balance between the two sets of Stirling cycle engines into consideration.

In this case, the two sets of configurations each constituted by "one displacer and one piston" are provided, and the device for heat exchange is arranged not annularly but separately. Therefore, the arrangement is called "canister arrangement of a heat exchanger" in this embodiment. The heat exchanger may be, however, arranged annularly.

In order to configure the Stirling cycle engine as a Stirling engine generator also in the sixth embodiment, it will do to replace the compression piston 59, the low temperature chamber, the cooler 54, the cool accumulator 55 and the radiator 56 by a power piston, a high temperature chamber, a heater, a generator and a cooler, respectively.

As has been described in detail above, the Stirling cycle engine according to the present invention exhibits the following effects.

(1) In the configuration according to the first aspect of the present invention, since an existing semi-hermetic compressor may be used as a driving portion of the Stirling cycle engine, it becomes possible to provide a desired Stirling cycle engine such as a Stirling refrigerator, a Stirling engine generator, or the like, by a simple configuration in which a Stirling cycle mechanism portion is connected to a compression element side of the compressor.

(2) If the cylinder portion of the compressor is used as a cross guide according to the first and second aspects of the present invention, it is possible to eliminate run-out to thereby reduce mechanical loss and prevent the cylinder from being damaged.

(3) If the cross guides of the pistons or displacers reciprocating in the cylinders provided side by side are arranged so as to have a predetermined phase difference according to the third aspect of the present invention, the driving force of the compressor provided in the housing can be properly transmitted as a working force of the compression pistons or displacers.

(4) If an airtight seal is provided on the sealing surface of the housing of the compressor according to the fourth aspect of the present invention, it is possible to prevent unexpected leakage of working gas.

(5) If a flywheel is provided in at least one end of a crank shaft to which a piston or a displacer is connected according to the fifth aspect of the present invention, it is possible to reduce the influence of the fluctuation in output of the engine by the moment of inertia of this flywheel.

What is claimed is:

1. A Stirling cycle engine comprising:

a housing having at least two cylinders;

a motor disposed in said housing;

a Stirling refrigerator portion having a displacer reciprocating in one of the two cylinders;

a piston reciprocating in the other of the two cylinders and being driven by said motor;

cross guide heads mounted inside said housing for guiding the piston and the displacer of said Stirling refrigerator portion; and a crank shaft for connecting the motor to the piston and the displacer.

2. A Stirling cycle engine comprising:

a housing having at least two cylinders;

an electric generator disposed in said housing;

a Stirling refrigerator portion having a displacer reciprocating in one of the two cylinder;

a piston reciprocating in the other of the two cylinders and driving the electric generator;

cross guide heads mounted inside said housing for guiding the piston and the displacer of said Stirling refrigerator portion; and a crank shaft for connecting the electric generator to the piston and the displacer.

3. A Stirling cycle engine according to claim 1 or 2, wherein the cross guide heads for the piston and the displacer are provided side by side with a phase difference therebetween.

4. A Stirling cycle engine according to claim 1 or 2, further comprising:

an air-tight gasket seal provided on a sealing surface of said housing.

5. A Stirling cycle engine according to claim 1 or 2, further comprising:

a flywheel provided on at least one end of the crank shaft to which the piston and the displacer is connected.

6. A Stirling cycle engine according to claim 1 or 2, wherein a passageway interconnects the two cylinders.

* * * * *